United States Patent [19]

Swanson

[11] 3,936,082

[45] Feb. 3, 1976

[54] CATCH WITH ANTI-RELEASE LATCH

[75] Inventor: Gunnar E. Swanson, Middletown, Conn.

[73] Assignee: The Nielsen Hardware Corporation, Hartford, Conn.

[22] Filed: Oct. 11, 1974

[21] Appl. No.: 514,200

[52] U.S. Cl. ..... 292/113; 292/106; 292/247; 292/DIG. 31; 292/DIG. 49

[51] Int. Cl.[2] ..... E05C 5/00

[58] Field of Search .... 292/113, 114, 247, DIG. 31, 292/DIG. 49, 106, 108

[56] References Cited

UNITED STATES PATENTS

| | | | |
|---|---|---|---|
| 2,951,722 | 9/1960 | Swanson | 292/247 |
| 3,384,402 | 5/1968 | Swanson | 292/113 |

*Primary Examiner*—Robert L. Wolfe

*Attorney, Agent, or Firm*—McCormick, Paulding & Huber

[57] ABSTRACT

A catch for releasably securing together two separable parts and comprising a base member mounted on one of the parts, an operating lever pivotally supported on the base member, an adjustable draw bar carried by the operating lever and movable into and out of connected relation with an associated strike mounted on the other of the parts, and a control lever assembly carried by the operating lever for cooperating with the base member to releasably latch the operating lever in a closed position to maintain the draw bar in connected relation with the strike. Compound movement of the control lever assembly is required to effect release of the operating lever from its closed position.

38 Claims, 11 Drawing Figures

CATCH WITH ANTI-RELEASE LATCH

BACKGROUND OF THE INVENTION

This invention relates in general to a catch of the type operative to secure together two separable panels for quick release, as for example, the body and cover of a container or the like, and deals more particularly with an improved catch of toggle action type which includes an anti-accidental release latching mechanism.

The general aim of the present invention is to provide an improved catch of the aforedescribed general type which may be operated with one hand and which includes an anti-release latching mechanism which will not accidentally release even under severe conditions of shock or vibration. A further aim of the invention is to provide a low profile catch having great strength and structural integrity and which may include an adjustable draw bar.

SUMMARY OF THE INVENTION

In accordance with the present invention, an improved catch for releasably securing together two separable parts is provided which comprises a base member, an operating lever pivotally supported on the base member for movement between open and closed positions, a draw bar, and means connecting the draw bar to the operating lever for movement therewith from a released position to a position of holding engagement with a strike in response to movement of the operating lever to its closed position. A control assembly carried by the operating lever and movable therewith and relative thereto includes a control member supported on the operating lever and a latch element supported for movement with the control member and relative thereto between latching and releasing positions. The latch element in its latching position cooperates with the control member and with the base member to releasably retain the operative lever in its closed position. Means is provided to move the latch element relative to the control member and the base member and to its releasing position in response to movement of the control member relative to the operating lever and the base member. The draw bar connecting means may be adjustable. Means may also be provided for releasably retaining the draw bar in preselected position relative to the operating lever.

DETAILED DESCRIPTION OF THE PREFERRED EMBODIMENT

Figure 1:
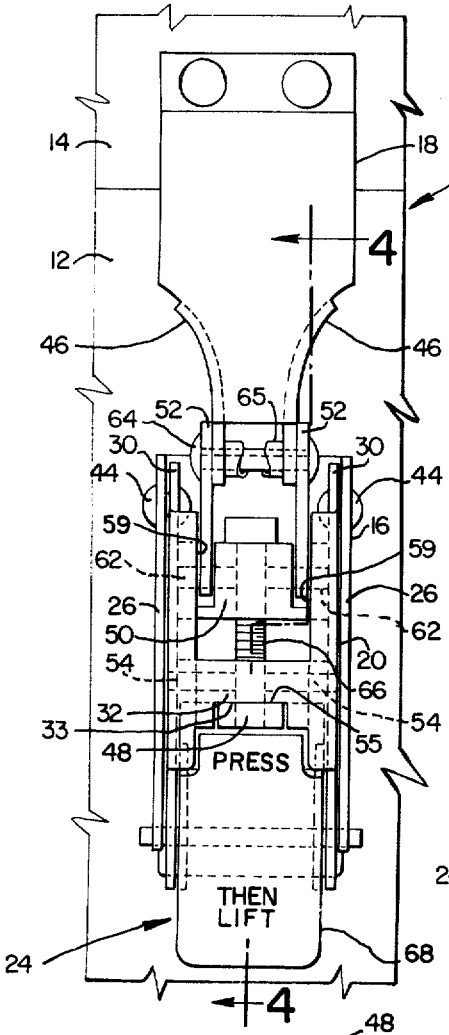
FIG. 1 is a front elevational view of a catch embodying the invention and shown in closed position.
Figure 2:
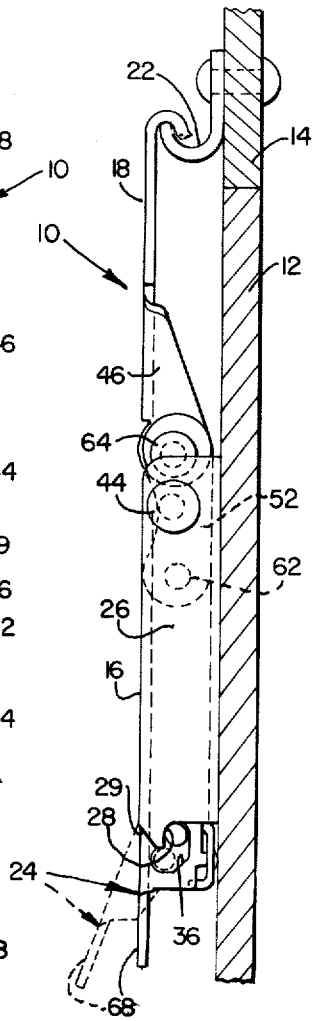
FIG. 2 is a side elevational view of the catch of FIG. 1.
Figure 3:
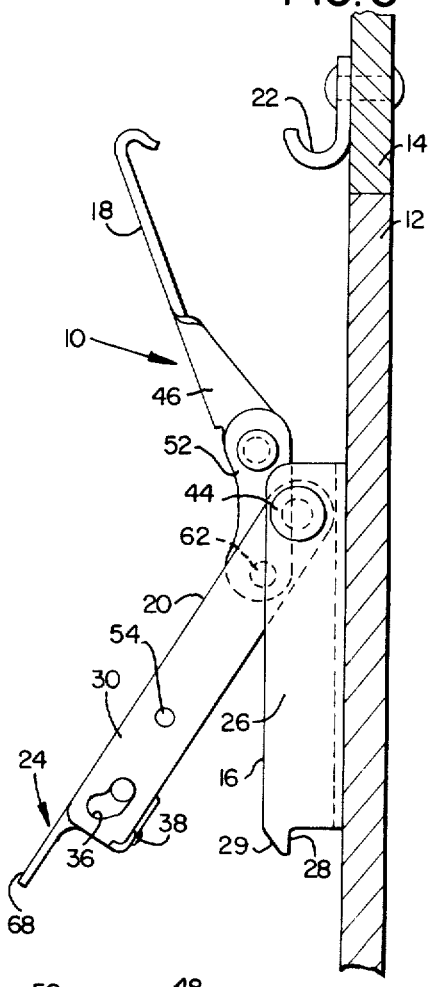
FIG. 3 is similar to FIG. 2, but shows the catch in an open or released position.

Turning now to the drawings, and referring first particularly to FIGS. 1–3, a toggle catch embodying the present invention is designated generally by the reference numeral 10. The catch 10 is particularly adapted to releasably secure together two separable panels 12 and 14, which may, for example, respectively comprise the body and cover of a container or the like. The catch is shown mounted on the panel 12 and includes a base member 16, a connecting member or draw bar 18 and an operating lever 20 pivotally connected to the draw bar and to the base member for moving the draw bar into and out of connected engagement with a strike 22 mounted on the panel 14 in alignment with the catch 10. A control assembly indicated generally at 24 and carried by the operating lever 20 cooperates with the operating lever and the base member to releasably retain the catch 10 in its closed position, as it appears in full lines in FIGS. 1 and 2.

Figure 7:
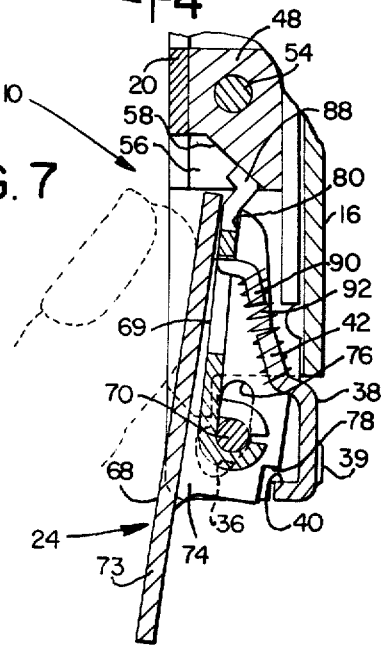
FIG. 7 is a fragmentary sectional view taken generally along the line 7—7 of FIG. 6, but shows the control assembly in a partially released position.
Figure 8:
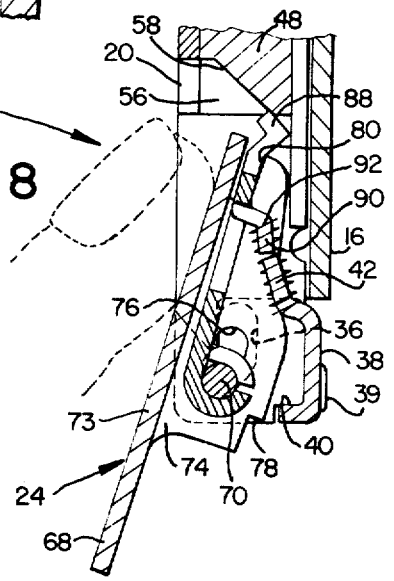
FIG. 8 is generally similar to FIG. 7 but shows a further position of the control member assembly.
Figure 9:
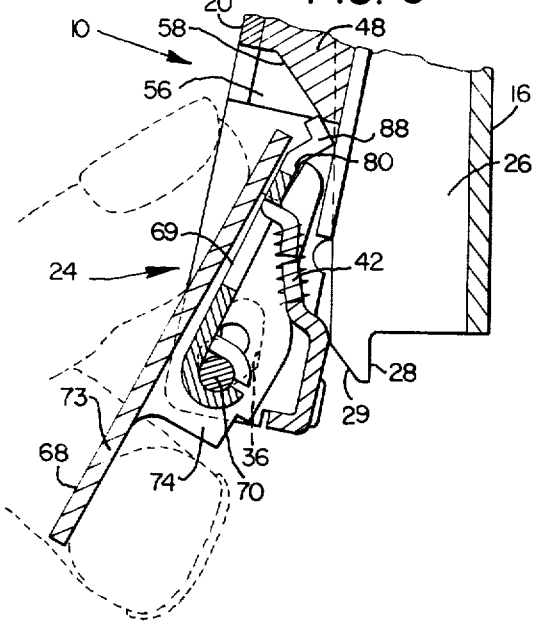
FIG. 9 is similar to FIG. 7 but shows the control lever assembly in a fully released position and the operating lever in an open position.
Figure 5:
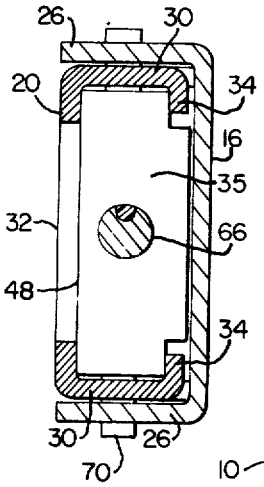
FIG. 5 is a sectional view taken along the line 5—5 of FIG. 4.

Considering now the catch structure in further detail and referring to the catch in its closed or holding position, the base member 16 is adapted to be mounted on a flat surface, such as the surface of the panel 12, and includes two transversely spaced and forwardly extending flanges 26, 26. Each flange 26 has a downwardly projecting ear at its forward end which defines a rearwardly facing abutment surface 28. Each ear further defines a forwardly and upwardly inclined cam surface 29. The operating lever 20 comprises an elongated hollow channel member formed from flat metal and has a pair of transversely spaced side walls 30, 30 connected by an integral transversely extending central web 32 which defines a downwardly facing abutment surface 33. The operating lever 20 further includes a pair of opposing front flanges 31, 31 and a pair of opposing rear flanges 34, 34 which respectively project inwardly from the side walls 30, 30 to further define the lever channel which is indicated by the numeral 35, as best shown in FIG. 5. Each side wall 30 has a cam slot 36 formed near its lower end. The upper portion of each slot 36 is generally aligned with the longitudinal axis of the operating lever 20 whereas the lower rear portion of each slot defines a downwardly and forwardly inclined cam surface, as most clearly shown in FIG. 3. The operating lever 20 further includes a support member 38 held in assembly by staked tabs 39, 39 which project rearwardly from the lower ends of the side walls 30, 30. The support member extends transversely between the side walls 30, 30 and further defines the lower end of the lever channel 35. A lower edge of the support member 38 is bent forwardly to form a generally upwardly facing abutment surface 40 at the lower end of the operating lever channel 35. At its upper end the support member 38 has a central spring retaining tab 42 disposed within the lever channel 35 and forwardly and upwardly inclined, as best shown in FIGS. 7–9. The operating lever 20 is received between the base flanges 26, 26 and supported for pivotal movement relative to the base member 16 by a pair of pivot rivets 44, 44 carried by the base flanges 26, 26.

The draw bar or claw 18 is formed from flat metal and is preferably adjustably connected to the operating lever 20. It has a hook or claw at its upper end for connecting engagement with the strike 22 and a pair of rearwardly extending apertured flanges 46, 46 at its lower end. Adjustable connection between the operating member 20 and the claw 18 is provided by an adjustment block 48, a pivot block 50 and a pair of connecting links 52, 52. The adjustment block 48 is preferably formed from high strength sintered steel and retained in fixed position within a central portion of the lever channel 35 by a pair of retaining pins 54, 54. Each pin 54 extends through an aperture in an associated lever side member 30 and is driven into an associated side of the adjustment block 48. The adjustment block 48 has an upwardly facing shoulder 55 at its forward end which engages the downwardly facing abutment surface 33 to resist upward movement of the block 48 within the channel 35 in response to upward force exerted by the draw bar 18. Recesses 56, 56 are formed in the adjustment block 48 at opposite sides thereof. Each recess 56 opens downwardly and outwardly through an associated side of the block and is partially defined by a generally downwardly facing and rearwardly and downwardly inclined cam surface 58, as best shown in FIGS. 7–9. The pivot block 50 is also preferably made from high strength sintered steel and slidably received in the upper end of the lever channel 35. It comprises a generally rectangular block which has a pair of transversely spaced apart and upwardly opening slots 59, 59 extending therethrough for receiving the links 52, 52. Each slot is partially defined by a forwardly and downwardly inclined bottom wall 60, shown in FIG. 4.

Figure 10:
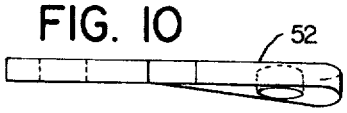
FIG. 10 is a somewhat enlarged frontal view of a connecting link.
Figure 11:
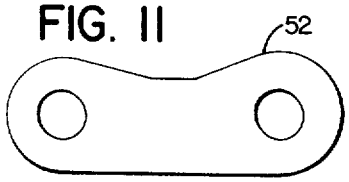
FIG. 11 is a side elevational view of the link of FIG. 10.

The links 52, 52 are made from resilient material, such as steel, and are of opposite hand. Each link 52 is twisted about its longitudinal axis so that one end portion is out of the plane of the opposite end portion thereof. In FIGS. 9 and 10, a typical right-hand link is shown. The left-hand link is substantially identical, but twisted in the opposite direction about its longitudinal axis. The lower end of each link is received in an associated slot 59 and is retained therein by an associated pivot pin 62. The links 52, 52 are assembled with the pivot block 50 before the block is inserted into the lever channel 35. Thus, the lever side walls 30, 30 serve to retain the pins 62, 62 in the pivot block 50. The upper ends of the links 52, 52 are connected to the claw flanges 46, 46 by a pivot rivet 64 which extends through the links and the apertured flanges 46, 46 and through a tubular sleeve 65 disposed between the flanges 46, 46 as best shown in FIG. 1. The rivet 64 is headed after the links 52, 52 have been assembled with the pivot block 50 whereby to exert torque on each of the links 52, 52 and establish frictional binding relation between the upper ends of the links 52, 52 and the claw flanges 46, 46. Frictional binding engagement is also established between the lower end of each link 52 and the walls of the slot 59 in which it is received. Thus, the claw 18 is arranged for pivotal movement relative to the operating lever 20 and tends to remain in any selected position in which it is placed.

As previously noted, the position of the claw 18 is adjustable relative to the strike 22. An adjustment screw 66 passes downwardly through an aperture in the pivot block 50 and threadably engages the adjustment block 48, as best shown in FIG. 5. The adjustment screw 66 preferably comprises a LONG-LOK socket head screw which has an axially extending nylon insert therein for frictional binding engagement in the threaded opening in the block 48, whereby to releasably retain the adjustment screw 66 in any predetermined position of adjustment.

Figure 4:
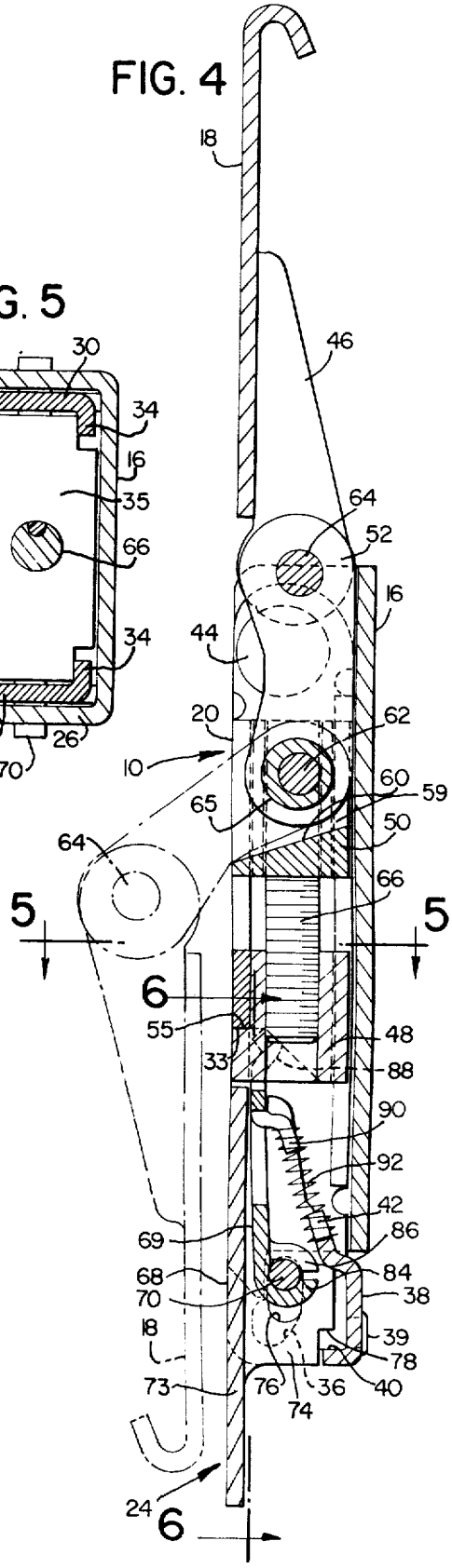
FIG. 4 is a somewhat enlarged sectional view taken generally along the line 4—4 of FIG. 1.
Figure 6:
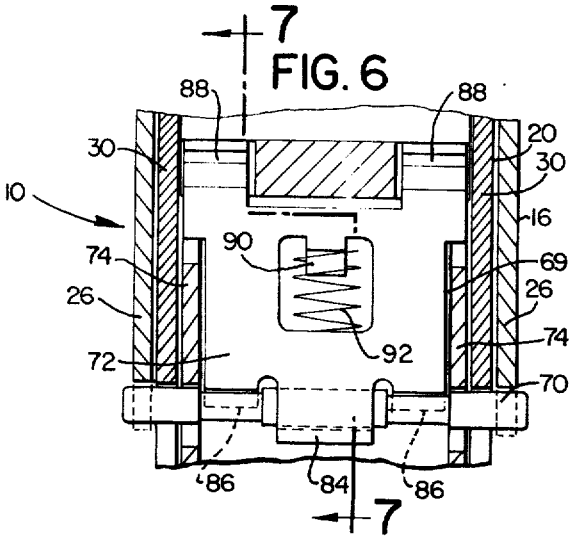
FIG. 6 is a sectional view taken along the line 6—6 of FIG. 4.

Referring now particularly to FIGS. 4 and 6, the control assembly 24 comprises a control member or lever 68 and a latch element 69 which includes a latch pin 70 and a latch pin plate 72. The control lever 68 is preferably formed from flat metal and has a central web 73 which provides transverse connection between a pair of integral flanges 74, 74 which extend rearwardly therefrom. Each flange 74 has a guide slot 76 formed therein which is generally parallel to the longitudinal axis of the lever and generally vertically disposed when the control lever 68 is in its closed or holding position as it appears in FIG. 4. A notch formed at the lower rear end portion of each flange 74 defines a generally downwardly facing abutment surface 78. Each flange 74 has an upwardly opening slot 80 formed therein and partially defined by the rear surface of the central web 73. The control lever 68 is received between the operating lever side members 30, 30 and is retained in assembly with the operating lever 20 by the latch pin 70, the respective end portions of which extend transversely outwardly through the guide slots 76, 76 in the control lever 68 and through and beyond the cam slots 36, 36 and the operating lever 20. The latch-pin plate 72 carries the latch pin 70 and is supported for movement with and relative to the control lever 68. It is positioned rearwardly of the central web 73 and extends generally between the flanges 74, 74 as best shown in FIG. 6. Tabs 84 and 86, 86 formed at the lower end of the latch-pin 72 are bent around the latch pin 70 to retain it in assembly with the plate. A pair of integral cam tabs 88, 88 extend upwardly at opposite sides of the plate 72, each tab 88 being disposed within an associated recess 56. Each tab 88 has a cam surface on its upper end for coengagement with an associated cam surface 58 on the adjustment block and is partially disposed within an associated slot 80. Thus, the slots 80, 80 which receive the tabs 88, 88 and the slots 76, 76 which receive the pin 70 therethrough cooperate to retain the latch element 69 for limited movement longitudinally of the control lever 68. The latch-pin plate 72 also has a spring retaining tab 90, struck from its central portion, which extends rearwardly and downwardly into the lever channel 35. A spring 92 retained on the tabs 90 and 42 acts between the operating lever 20 and the latch-pin plate 72 to bias latch element 69 and the control lever upwardly in the direction of the claw 18.

Considering now the operation of the catch, when the catch 10 is latched in its closed or holding position, as it appears in FIG. 1 and in full lines in FIG. 2, the latch element 69 is biased upwardly by the spring 92 so that the latch-pin 70 is disposed in the upper portions of the guide slots 76, 76 and the cam slots 36, 36. When the latch element 69 is in the latter position, the free end portions of the pin 70 are located rearward of the abutment surfaces 28, 28 on the base member 16. Thus, the pin 70 cooperates with the base member 16 to prevent the operating lever 20 from being pivoted in a forward direction and away from the base member toward its open position.

The words "PRESS" — "THEN LIFT" imprinted on the frontal surface of the control lever 68, as shown in FIG. 1, constitute operating instructions for the catch 10. To open the catch 10 pressure is first applied in a rearward direction to the upper end portion of the control lever 68, as for example, by applying thumb pressure thereto as generally indicated in FIG. 7. This applied pressure results in a compound motion which includes simultaneous pivotal movement of the control lever 68 and the latch element 69 and longitudinal movement of the latch element 69 relative to the control lever 68. More specifically, when pressure is applied to the upper end portion of the control lever 68, as shown in FIG. 7, the control lever pivots in a clockwise direction which causes the cam tabs 88, 88 to move in coengagement with the respectively associated cam surfaces 58, 58 on the adjustment block 48. The resulting initial movement of the latch element 69 causes the pin 70 to move downward to the lower end of the guide slots 76, 76 and toward the lower end portions of the cam slots 36, 36 and to the position generally shown in FIG. 7. Thereafter, further pressure on the upper end of the control lever 68 causes the control lever 68 and latch element 69 to move in unison, urged downward by coengagement of the tabs 88, 88 and the cam surfaces 58, 58. When the end portions of the latch-pin 70 respectively engage the cam surfaces on the lower rear portions of the cam slots 36, 36, the downwardly moving latch-pin 70 is cammed in a forwardly direction thereby causing the downwardly facing stop or abutment surfaces 78, 78 on the control lever 68 to move out of vertical alignment with the upwardly facing stop or abutment surface 40 on the support member 38. When the ends of the pin 70 respectively reach the lower ends of the cam slots 36, 36 it will be noted that the pin 70 has advanced to a position below and slightly forwardly of the abutment surfaces 28, 28, as best shown in FIG. 7. Due to the cooperative action of the latch-pin 70 and the cam slots 36, 36, when the control assembly 24 is pivoted to its position in FIG. 8, as by pressing on the upper end of the control lever 68, the lower end of the control lever is cammed in a forward direction to a position a substantial distance from the face or mounting surface of the panel 14. This camming action provides for finger clearance between the rear surface of the control lever and the mounting surface. When the control lever 68 reaches the position shown in FIG. 8, the upper rear portions of the control lever flanges 74, 74 respectively engage the associated rear flanges 34, 34 on the operating lever 20 so that further clockwise rotation of the control lever 68 from the position shown in FIG. 8 causes the control assembly 24 and the operating lever 20 to move together. The catch 10 may now be opened to release the claw 18 from the strike 22 by lifting the lower end of the control lever 68, as shown in FIG. 9, wherein lifting pressure is shown being applied to the lower end of the control lever by an index finger inserted behind the control lever. When the control lever 68 is released after the catch 10 has been opened, biasing force exerted by the compression spring 92 causes the control lever 68 to return to its normal position of longitudinal alignment with the operating member 20, as it appears in FIG. 3.

The catch 10 may be returned to its closed or holding position by aligning the claw 18 with the strike 22 and then rotating the operating lever 20 in counterclockwise direction from its position in FIG. 3. As the operating lever approaches its closed or holding position, the free ends of the latch-pin 70 engage the cam surfaces 29, 29 to urge the latch-pin in a generally downward direction until it attains its latched position rearward of the abutment surfaces 28, 28.

It will now be evident that a compound motion is required to release the catch 10 when it is latched in its holding position. Thus, if the catch 10 is subjected to severe shock or vibrational force which tends to move both the control lever 68 and the latch element 69 in only a longitudinal direction relative to the operating lever, the abutment surfaces 78, 78 will engage the abutment surface 40 before the latch-pin 70 can move downwardly beyond the abutment surfaces 28, 28. Thus, the catch 10 will resist accidental release even when subjected to severe shock or vibrational force.

Utilization of a channel shaped operating lever facilitates the provision of an adjustable toggle catch of low profile which possesses great strength and integrity. The use of a channel shaped operating lever and adjustment and pivot blocks which are slidably received within the operating lever channel aid in assembly of the catch. The arrangement of the link connection between the operating lever 20 and the claw 18 facilitates placement and retention of the claw in convenient preselected position. Referring to FIG. 5 it will be noted that the links 52, 52 are shaped to cooperate with the inclined surfaces 60, 60 on the pivot block so that the claw 18 may swing through an arc of 180° to a position in closely spaced relation to the frontal surface of the operating lever 20. Due to the frictional binding engagement of the links 52, 52 with the claw 18 and the pivot block 50, the claw will resist movement from any preselected position in which it is placed relative to the operating lever 20.

I claim:

1. In a catch for releasably securing one part to another part carrying a strike, the catch having a base member adapted to be attached in fixed position to the one part, an operating lever, means connecting said operating lever to said base member for pivotal movement relative thereto between open and closed position, a drawbar, means connecting said drawbar to said operating lever for movement therewith into and out of connected engagement with the strike, said operating lever being operable upon movement to its closed position to move said drawbar into and retain it in connected engagement with the strike, a control assembly including a control member and a latch element, and means supporting said control assembly on said operating lever for movement relative thereto and to said base member between latching and releasing positions and for movement with said operating lever between its open and closed positions, said control member being supported for movement with said operating lever and relative thereto, said latch element being supported for movement with said control member and relative thereto and cooperating with said base member in said latching position to releasably retain said operating lever in its closed position, the improvement comprising first means for moving said latch element relative to said control member, relative to said operating lever and relative to said base member during one portion of the travel of said control assembly from its latching toward its releasing position, and second means for moving said latch element and control member in unison and relative to said operating lever and said base member during another portion of the travel of said control assembly from its latching toward its releasing position to move said latching means out of latching engagement with said base member in response to movement of said control assembly from its latching toward its releasing position.

2. The combination as set forth in claim 1 wherein said latching means comprises said supporting means.

3. The combination as set forth in claim 1 including stop means for limiting movement of said control member in a longitudinal direction relative to said operating lever when said operating lever is in its closed position and said control assembly is in its latching position to prevent said latching means from moving out of latching engagement with said base member in response to movement of said control member in only said longitudinal direction relative to said operating member.

4. The combination as set forth in claim 3 wherein said stop means comprises coengageable abutment surfaces on said operating lever and said control member.

5. The combination as set forth in claim 1 including means for biasing said latch element toward its latching position.

6. The combination as set forth in claim 5 wherein said spring acts between said latch element and said operating lever.

7. The combination as set forth in claim 1 wherein said control member comprises a control lever, said first means comprises means for moving said latch element in a direction parallel to the longitudinal axis of said control lever, and said second means comprises means for moving said latch element and said control lever in unison and in a direction inclined to the longitudinal axis of said operating lever.

8. The combination as set forth in claim 7 wherein said latch element comprises said supporting means and defines the pivotal axis of said control assembly and said means for moving said latch element comprises means for moving said pivotal axis of said control assembly relative to said operating lever.

9. The combination as set forth in claim 8 wherein said pivotal axis of said control member is generally parallel to the pivotal axis of said operating lever.

10. The combination as set forth in claim 7 wherein said latch element includes a pin disposed in a slot in said control lever and disposed in another slot in said operating lever.

11. The combination as set forth in claim 10 wherein said first means comprises a cam surface defining a portion of said slot in said control lever and said second means comprises another cam surface defining a portion of said other slot.

12. The combination as set forth in claim 11 wherein said latch element includes a plate which carries said pin and said first and second means includes a cam surface on said operating lever engaging said plate.

13. The combination as set forth in claim 12 wherein said pin comprises said latching means.

14. The combination as set forth in claim 13 wherein said base member has an abutment surface and said pin latchingly engages said abutment surface in said latching position.

15. In a catch for releasably securing one part to another part carrying a strike, the catch having a base member adapted to be attached in fixed position to the one part, an operating lever, means connecting said operating lever to said base member for pivotal movement relative thereto between open and closed position, a drawbar, means connecting said drawbar to said operating lever for movement therewith into and out of connected engagement with the strike, said operating lever being operable upon movement to its closed position to move said drawbar into and retain it in connected engagement with the strike, a control assembly, and means supporting said control assembly on said operating lever for movement relative thereto and to said base member between latching and releasing positions and for movement with said operating member between its open and closed positions, said control assembly cooperating with said base member in said latching position to releasably retain said operating lever in its closed position, the improvement comprising said control assembly including a control member supported for movement with said operating lever and relative thereto, a latch element having a latch-pin for latching engagement with said base member in said latching position, said latch-pin comprising said means supporting said control assembly and supporting said control member on said operating lever for movement relative thereto, said latch-pin further supporting said latch element on said control member for movement therewith and relative thereto, and means for moving said latch-pin out of latching engagement with said base member in response to movement of said control assembly from its latching toward its releasing position.

16. The combination as set forth in claim 15 wherein said latch-pin is disposed within a pair of slots in said operating lever and within another pair of slots in said control member.

17. The combination as set forth in claim 16 wherein said means for moving said latch-pin out of latching engagement comprises cam means defined by said slots in said operating lever.

18. The combination as set forth in claim 17 wherein said means for moving said latch-pin out of latching engagement further includes coengaging cam surfaces on said operating lever and said latch element.

19. In a catch for releasably securing one part to another part upwardly separable from the one part and carrying a strike, the catch having a base member adapted to be attached in fixed position to the one part below the strike, an operating lever, means connecting said operating lever to said base member for pivotal movement about a fixed horizontal axis relative to said base between open and closed position, a drawbar, means connecting said drawbar to said operating lever for movement therewith into and out of connected engagement with the strike, said operating lever being operable upon pivotal movement in a rearward direction toward said base to its closed position to move said drawbar downward into and retain it in connected engagement with the strike, a control assembly including a control lever and a latch element, and means supporting said control assembly on said operating lever for movement relative thereto and to said base member between latching and releasing positions and for pivotal movement with said operating lever between its open and closed positions, said control assembly cooperating with said base member in said latching position to releasably retain said operating lever in its closed position, the improvement comprising said operating lever having a generally downwardly facing cam surface thereon downwardly and rearwardly inclined in the direction of said base member when said operating lever is in its closed position, said latch element latchingly engaging said base member in said latching position and including a plate having a cam at its upper end engaging said cam surface, said latch element having a pin secured to said plate below said cam, said pin supporting said latch element on said control lever for pivotal movement with said control lever and for movement generally longitudinally of said control lever and comprising said means supporting said control assembly on said operating lever, said cam cooperating with said cam surface to move said latch element generally downwardly and out of latching engagement with said base in response to movement of said control assembly from its latching toward its releasing position.

20. The combination as set forth in claim 19 wherein said latch element is supported for movement in a downward direction generally longitudinally of said operating member and said control lever during an initial portion of the travel of said control assembly from its latching to its releasing position and with said control lever and in a generally downwardly and forwardly inclined direction relative to the longitudinal axis of said operating lever during said another portion of the travel of said control assembly from its latching toward its releasing position.

21. The combination as set forth in claim 20 wherein said pin is disposed in a slot in said control lever and in another slot in said operating lever and said other slot defines a cam surface for cooperating with said pin to move said latch element with said control lever during said other portion of the travel of said control assembly from its latching toward its releasing position.

22. In a catch for releasably securing one part to another part carrying a strike, the catch having a base member adapted to be attached in fixed position to the one part, an operating lever, means connecting said operating lever to said base member for pivotal movement relative thereto between open and closed position, a drawbar, means connecting said drawbar to said operating lever for movement therewith into and out of connected engagement with the strike, said operating lever being operable upon movement to its closed position to move said drawbar into and retain it in connected engagement with the strike, a control assembly including a control lever and a latch element, and means supporting said control assembly on said operating lever for pivotal movement relative thereto and to said base member between latching and releasing positions and for movement in a longitudinal direction relative to said operating lever and with said operating lever between its open and closed positions, said control assembly cooperating with said base member in said latching position to releasably retain said operating lever in its closed position, the improvement comprising said control lever being supported for pivotal movement with said operating lever and relative thereto and for movement in a generally longitudinal direction relative to said operating lever, said latch element being supported for movement with said control lever and in a generally longitudinal direction relative thereto, said latch element including a latch plate and a latch pin carried by said latch plate and disposed in a slot in said control lever and in another slot in said operating lever, said latch pin being engageable with said base in said latching position to releasably retain said operating member in its closed position, means for moving said latch element relative to said control lever, relative to said operating lever and relative to said base member during one portion of the travel of said control assembly from its latching toward its releasing position, and means for moving said latch element and control lever in unison and relative to said operating lever and said base member during another portion of the travel of said control assembly from its latching toward its releasing position to move said latching means out of latching engagement with said base member in response to movement of said control assembly from its latching toward its releasing position, said means for moving said latch element comprising cam means defined by said other slot for engaging said latch pin and a cam surface on said operating lever engaging said plate.

23. In a catch for releasably securing one part to another part carrying a strike, the catch having a base member adapted to be attached in fixed position to the one part, an operating lever, means connecting said operating lever to said base member for pivotal movement relative thereto between open and closed position, a drawbar, means connecting said drawbar to said operating lever for movement therewith into and out of connected engagement with the strike, said operating lever being operable upon movement to its closed position to move said drawbar into and retain it in connected engagement with the strike, a control assembly including a control member and a latch element, and means supporting said control assembly on said operating lever for movement relative thereto and to said base member between latching and releasing positions and for movement with said operating lever between its open and closed positions, said control assembly cooperating with said base member in said latching position to releasably retain said operating lever in its closed position, the improvement comprising said latch element having a latch pin supporting said control member for movement with said operating lever and relative thereto and supporting said latch element for movement with said control member and relative thereto, said latch pin being engageable with said base member in said latching position, means for moving said latch element relative to said control member, relative to said operating lever and relative to said base member during one portion of the travel of said control assembly from its latching toward its releasing position, and means for moving said latch element and control member in unison and relative to said operating lever and said base member during another portion of the travel of said control assembly from its latching toward its releasing position to move said latch pin out of latching engagement with said base member in response to movement of said control assembly from its latching toward its releasing position.

24. In a catch for releasably securing one part to another part carrying a strike, the catch having a base member adapted to be attached in fixed position to the one part, an operating lever, means connecting said operating lever to said base member for pivotal movement relative thereto between open and closed position, a drawbar, means connecting said drawbar to said operating lever for movement therewith into and out of connected engagement with the strike, said operating lever being operable upon movement to its closed position to move said drawbar into and retain it in connected engagement with the strike, a control assembly including a control member and a latch element, and means supporting said control assembly on said operating lever for movement relative thereto and to said base member between latching and releasing positions and for movement with said operating lever between its open and closed positions, said control assembly cooperating with said base member in said latching position to releasably retain said operating lever in its closed position, the improvement comprising said control member being supported for movement with said operating lever and relative thereto, said latch element having a latch pin supporting said control member for movement with said operating lever and supporting said latch element for movement with said control member and relative thereto, said latch pin being operable with said base in said latching position to releasably retain said operating member in its closed position, and co-engaging cam surfaces on said operating lever and said latch element for moving said latch element relative to said control member, relative to said operating lever and relative to said base member during one portion of the travel of said control assembly from its latching toward its releasing position and for moving said latch element and control member in unison and relative to said operating lever and said base member during another portion of the travel of said control assembly from its latching toward its releasing position to move said latch pin out of latching engagement with said base member in response to movement of said control assembly from its latching toward its releasing position.

25. The combination as set forth in claim 24 wherein said means for moving said latch element includes cam means on said operating lever engageable with said pin.

26. The combination as set forth in claim 24 wherein said latch element includes a plate, said pin is carried by said plate, and said cam surfaces include one cam surface on said operating lever for cammingly engaging said plate and another cam surface of said operating lever for cammingly engaging said pin.

27. In a catch for releasably securing one part to another part carrying a strike, the catch having a base member adapted to be attached in fixed position to the one part, an operating lever, means connecting said operating lever to said base member for pivotal movement relative thereto between open and closed position, a drawbar, means connecting said drawbar to said operating lever for movement therewitn into and out of connected engagement with the strike, said operating lever being operable upon movement to its closed position to move said drawbar into and retain it in connected engagement with the strike, a control assembly including a control member and a latch element, and means supporting said control assembly on said operating lever for movement relative thereto and to said base member between latching and releasing positions and for movement with said operating lever between its open and closed positions, said latch element having latching means cooperating with said base member in said latching position to releasably retain said operating lever in its closed position, the improvement comprising said latch element having a pin comprising said supporting means, said control member being supported for movement with said operating lever and relative thereto, said latch element being supported for movement with said control member and relative thereto, means for moving said latch element relative to said control member, relative to said operating lever and relative to said base member during one portion of the travel of said control assembly from its latching toward its releasing position, means for moving said latch element and control member in unison and relative to said operating lever and said base member during another portion of the travel of said control assembly from its latching toward its releasing position to move said pin out of latching engagement with said base member in response to movement of said control assembly from its latching toward its releasing position, and a cam surface on said base member for engaging said pin to move said latch element relative to said control member in response to movement of said control assembly from a releasing position to its latching position when said operating lever is moved to its closed position to move said latching means into latching engagement with said base member.

28. The combination as set forth in claim 27 wherein said pin comprises said latching means.

29. In a catch for releasably securing one part to another part carrying a strike, the catch having a base member adapted to be attached in fixed position to the one part, an operating lever, means connecting the operating lever to said base member for pivotal movement relative thereto between open and closed positions, a drawbar, means connecting said drawbar to said operating lever for movement therewith into and out of connected engagement with the strike, said operating lever being operable upon movement to its closed position to move said drawbar into and retain it in connected engagement with the strike, a control assembly, and means supporting said control assembly on said operating lever for movement relative thereto and to said base member between latching and releasing positions and for movement with said operating member between its open and closed positions, the improvement wherein said operating lever comprises a hollow lever having a channel extending longitudinally therethrough and an adjustment block mounted in fixed position in said channel and having a cam surface thereon, said means connecting said drawbar comprises a pivot block slidably received in said channel, means connecting said drawbar to said pivot block, and an adjustment screw acting between said pivot block and said adjustment block for adjusting the position of said pivot block relative to said operating lever, and said control assembly includes a control member supported for movement with said operating lever and relative thereto, and a latch element supported by said control member for movement therewith and relative thereto and having latching means for latching engagement with said base member in said latching position, said latching element having a cam thereon for cammingly engaging said cam surface to move said latching means out of latching engagement with said base member in response to movement of said control assembly from its latching toward its releasing position.

30. In a catch of releasably securing one part to another part upwardly separable from the one part and carrying a strike, the catch having a base member adapted to be attached in fixed position to the one part below the strike, an operating lever, means connecting said operating lever to said base member for pivotal movement about a fixed horizontal axis relative to said base between open and closed position, a drawbar, means connecting said drawbar to said operating lever for movement therewith into and out of connected engagement with the strike, said operating lever being operable upon pivotal movement in a rearward direction toward said base to its closed position to move said drawbar downward into and retain it in connected engagement with the strike, a control assembly including a control lever and a latch element, and means supporting said control assembly on said operating lever for movement relative thereto and to said base member between latching and releasing positions and for pivotal movement with said operating lever between its open and closed positions, said control assembly cooperating with said base member in said latching position to releasably retain said operating lever in its closed position, the improvement comprising said operating lever having a pair of transversely spaced longitudinally extending side walls, a pair of opposing transversely spaced and longitudinally extending integral rear flanges projecting inwardly from said side walls at the rear ends thereof, a pair of opposing transversely spaced and longitudinally extending integral front flanges projecting inwardly from said side walls at the forward ends thereof, and an integral transversely extending web generally centrally connecting said front flanges and defining a downwardly facing abutment surface, said side walls, said flanges and said central web cooperating to generally define longitudinally extending lever channeling, an adjustment block slidably received in said lever channeling and mounted in fixed position therein, said adjustment block having a downwardly facing cam surface and including an upwardly facing shoulder at its forward end engaging said downwardly facing abutment surface to resist upward movement of said adjustment block within said channeling, said means connecting said drawbar comprising a pivot block slidably received in said channeling above said adjustment block and having a pair of transversely spaced upwardly opening slots, a pair of connecting links, each of said links received in an associated one of said slots, means for retaining said links in said slots for pivotal movement relative to said pivot block, and an adjustment screw extending through one of the blocks and threadably engaging the other of said blocks for adjusting the position of the pivot block relative to the operating lever, said control assembly including a control lever supported for pivotal movement with said operating lever and relative thereto and a latch element supported by said control member for movement therewith and relative thereto and having latching means for latching engagement with said base member in said latching position, said latch element having a cam thereon for cammingly engaging said cam surface to move said latching means out of latching engagement with said base member in response to movement of said control assembly from its latching position toward its releasing position.

31. The combination as set forth in claim 30 wherein each of said blocks has a cross sectional configuration substantially complementing the cross sectional configuration of an associated portion of said channeling and a major portion having front-to-rear dimension substantially equal to the overall front-to-rear dimension of the side walls.

32. The combination as set forth in claim 30 wherein said control lever is pivotally supported intermediate its ends on said operating lever.

33. The combination as set forth in claim 30 wherein said means retaining said links comprises a pair of pins slidably received in said pivot block, each of said pins retaining as associated one of said links, said pins retained in assembly with said pivot block by said side walls.

34. The combination as set forth in claim 30 wherein said control lever is engagable with said front and rear flanges to limit pivotal movement of said control assembly.

35. The combination as set forth in claim 30 wherein said operating lever includes a support member connecting said walls and extending transversely therebetween at the lower ends thereof.

36. The combination as set forth in claim 35 wherein said support member has an upwardly facing abutment surface and said operating lever has a downwardly facing abutment surface for engagement with said upwardly facing abutment surface on said support member when said operating lever is in its closed position and said control assembly is in its latching position to prevent said latching means from moving out of latching engagement with said base in response to movement of said control member in only said longitudinal direction relative to said operating lever.

37. The combination as set forth in claim 35 wherein said support member has a spring retaining tab and said catch includes a spring retained on said tab and acting between said support member and said control member.

38. The combination as set forth in claim 7 wherein said control member comprises a control lever supported intermediate its ends to pivot about an axis extending transversely of said operating lever and said second means comprises means for camming said pivot axis away from said base member in response to pressure applied to one end of said control lever in the direction of said base member to move the other end of said control lever away from said base member whereby to provide finger clearance between said other end and said base member.

* * * * *